US005774054A

United States Patent [19]

Chen

[11] Patent Number: 5,774,054

[45] Date of Patent: Jun. 30, 1998

[54] SYNCHRONOUS RECEIVING/ TRANSMITTING DEPARTURE ALARM

[75] Inventor: Stephen Chen, Changhua, Taiwan

[73] Assignee: E Lead Electronic Co., Ltd., Changhua, Taiwan

[21] Appl. No.: 743,079

[22] Filed: Nov. 4, 1996

[51] Int. Cl.[6] ..... G08B 13/14

[52] U.S. Cl. ..... 340/572; 340/573; 340/539; 340/825.49; 455/343; 379/37

[58] Field of Search ..... 340/572, 573, 340/825.49, 539; 455/343; 379/37

[56] References Cited

U.S. PATENT DOCUMENTS

| | | | |
|---|---|---|---|
| 4,449,248 | 5/1984 | Leslie et al. | 455/343 |
| 5,175,868 | 12/1992 | Yasuoka | 340/572 |
| 5,245,314 | 9/1993 | Kah, Jr. | 340/573 |
| 5,357,254 | 10/1994 | Kah, Jr. | 340/573 |
| 5,490,286 | 2/1996 | Kah, Jr. | 455/343 |

*Primary Examiner*—Jeffery Hofsass
*Assistant Examiner*—Sihong Huang
*Attorney, Agent, or Firm*—Bacon & Thomas

[57] ABSTRACT

A synchronous receiving/transmitting departure alarm including a receiver unit and at least one transmitter unit cooperating with the receiver unit. Once a holder of the transmitter unit is far away from the holder of the receiver unit by a preset distance, the holder of the receiver unit can be in time warned. The transmitter unit intermittently transmits a clock pulse signal and a receiving circuit of the receiver unit is synchronously opened to receive the signal so as to judge whether the holder of the transmitter unit is within the preset distance. Therefore, a person under care or an article with the transmitter unit is prevented from missing or being lost. A mobile phone can be used with the alarm to inform the holder of the receiver unit of a phone call.

4 Claims, 7 Drawing Sheets

SYNCHRONOUS RECEIVING/ TRANSMITTING DEPARTURE ALARM

BACKGROUND OF THE INVENTION

The present invention relates to a synchronous receiving/transmitting departure alarm including a receiver unit and at least one transmitter unit cooperating with the receiver unit. The transmitter unit intermittently transmits a clock pulse signal and a receiving circuit of the receiver unit is synchronously activated to receive the signal so as to judge whether the holder of the transmitter unit is within a preset safety distance. Therefore, a person under care or a precious article carrying the transmitter unit is prevented from becoming missing or lost. A mobile phone can be used with the alarm to inform the holder of the receiver unit of a phone call.

The issue of how to take care of an old man, a child or a patient has become more and more important. Therefore, a departure alarm has been developed to effectively protect a person under care from becoming missing and rescue a person needing help. In addition, it is often a difficult job to keep a precious article in sight so as to prevent, the article from being stolen or lost. An owner often loses his/her precious property due to inattentiveness, or the precious property is stolen by a thief.

FIGS. 1 and 2 show a conventional departure alarm which has been developed for solving the above problems. Such alarm includes a transmitter unit 11 and a cooperative receiver unit 12. As shown in FIG. 1, the transmitter unit 11 includes an encoding selection switch 111, an encoder 112, a transmitting circuit 113 and an antenna 114. The encoding selection switch 111 serves to adjust the coupling code. After encoding by the encoder 112, the transmitting circuit 113 generates an electro-magnetic wave which is transmitted via the antenna 114. As shown in FIG. 2, the receiver unit 12 includes an antenna 121, a receiving circuit 122, a decoder 123, a decoding selection switch 124, an alarm control circuit 125 and a sound emitter 126. The signal from the transmitter unit 11 is received by the antenna 121 of the receiving circuit 122 and decoded by the decoder 123. Then the alarm control circuit 125 receives the signal. In case the receiver unit 12 fails to receive the signal, the alarm control circuit 125 triggers the sound emitter 126 to warn the user by sound. However, in use, several shortcomings exist in the above arrangement as follows:

1. The conventional alarm 1 employs the encoding selection switch 111 and the decoding selection switch 124 to couple the signal receiving and transmission of the receiving unit 12 and the transmitter unit 11. (Multiple transmitter units will lead to interference with each other.) Therefore, one alarm 1 can only have one transmitter unit 11 to couple with one receiver unit 12, while it is impossible to couple several transmitter units 11 with one receiver unit 12 at the same time. This greatly limits the practical usage of the alarm.

2. The transmitter unit 11 of the conventional alarm 1 continuously transmits signals or intermittently transmits signals each of which lasts a quite long period. Therefore, the power consumption is considerably great. Moreover, the receiver generally is activated continuously. This shortens the using life of the battery cell and it is necessary to frequently replace the cell with a new one and to keep available many spare cells.

3. The reception and transmission of signals by the conventional alarm are based on the encoding and decoding selection switches 111, 124 which have relatively complicated circuits and higher cost. In addition, the respective components have a large volume so that the volume of the alarm cannot easily be reduced and the alarm is not easily carried.

SUMMARY OF THE INVENTION

It is therefore a primary object of the present invention to provide a synchronous receiving/transmitting departure alarm which reliably prevents a precious article or a person under care from moving beyond a preset controllable range from a guardian.

It is a further object of the present invention to provide the above alarm by which, in case a person under care, such as a patient or an old man, needs help, the guardian is effectively warned and informed to rescue the person under care.

It is still a further object of the present invention to provide the above alarm in which one receiver unit can be coupled with multiple transmitter units at the same time to increase use ability.

It is still a further object of the present invention to provide the above alarm which also has the function of informing the user of a phone call.

According to the above objects, the synchronous receiving/transmitting departure alarm of the present invention includes a receiver unit and at least one transmitter unit cooperating with the receiver unit. The transmitter unit transmits a simple pulse signal at intervals of a fixed time and the receiver unit automatically uses the pulse clock of the transmitter unit to achieve synchrony, so that during the intervals within which the transmitter unit normally stops transmitting the signal, the receiving circuit of the receiver unit can be synchronously deactivated and so that before the next transmitted pulse is generated, the receiving circuit can again be activated to receive the signal from the transmitter unit. When the receiving circuit fails to receive the transmitted pulse signal once or continuously several times, the receiver unit by way of sound or vibration warns a holder of the receiver unit. The transmitter unit can also detect a signal from other electrical appliance ( such as a mobile phone ) or be controlled by a button which is able to change the waveform of the transmitted wave of the transmitter unit or make the transmitter unit stop transmitting the signal, whereby the receiver unit can generate a sound or vibration to warn the holder of the receiver unit. Several transmitter units can be coupled with one receiver unit at the same time, in which case the receiver unit reads the, time to transmit the pulses of each transmitter unit and accurately activates the receiving circuit at the proper times for receiving the pulses of the respective transmitter units.

The present invention can be best understood through the following description and accompanying drawings, wherein:

DETAILED DESCRIPTION OF THE PREFERRED EMBODIMENTS

Figure 1:
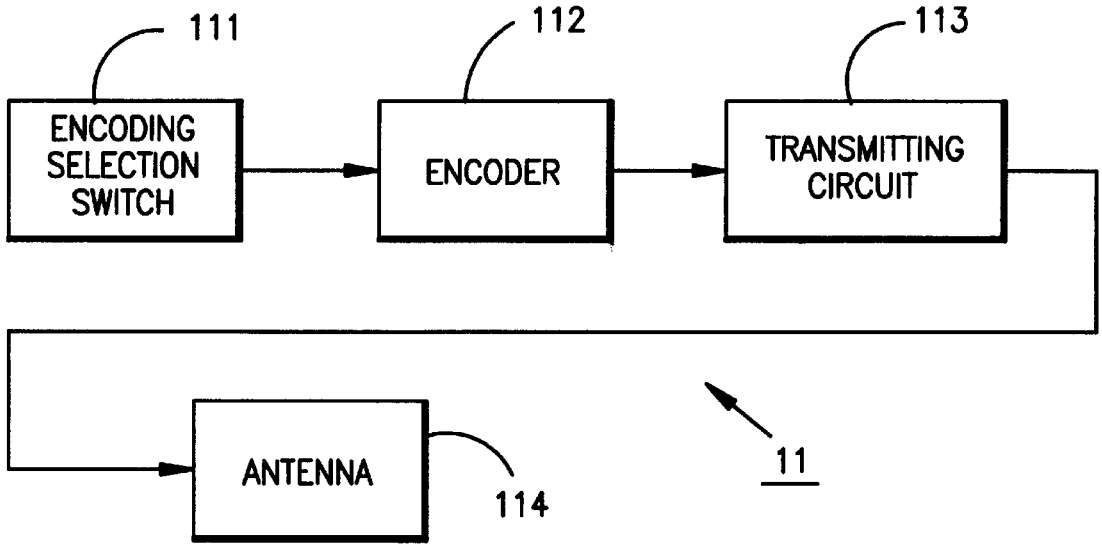
FIG. 1 PRIOR ART
FIG. 1 is a block circuit diagram of the transmitter unit of the conventional alarm.
Figure 2:
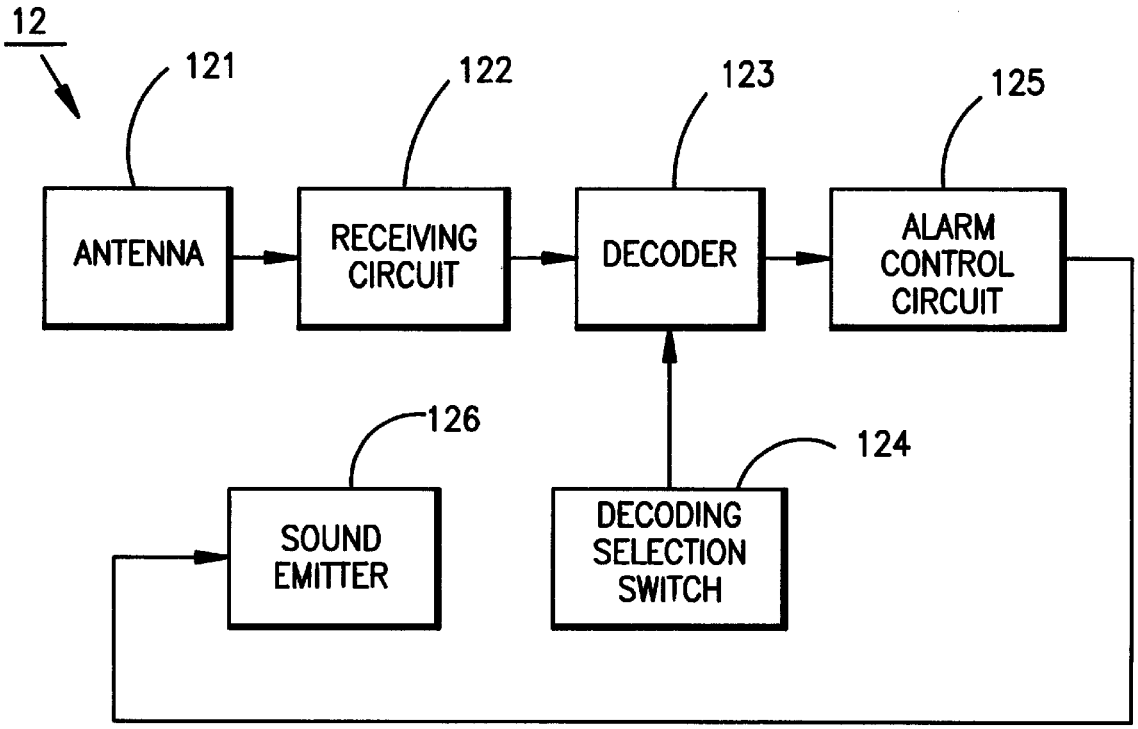
FIG. 2 PRIOR ART
FIG. 2 is a block circuit diagram of the receiver unit of the conventional alarm.
Figure 3:
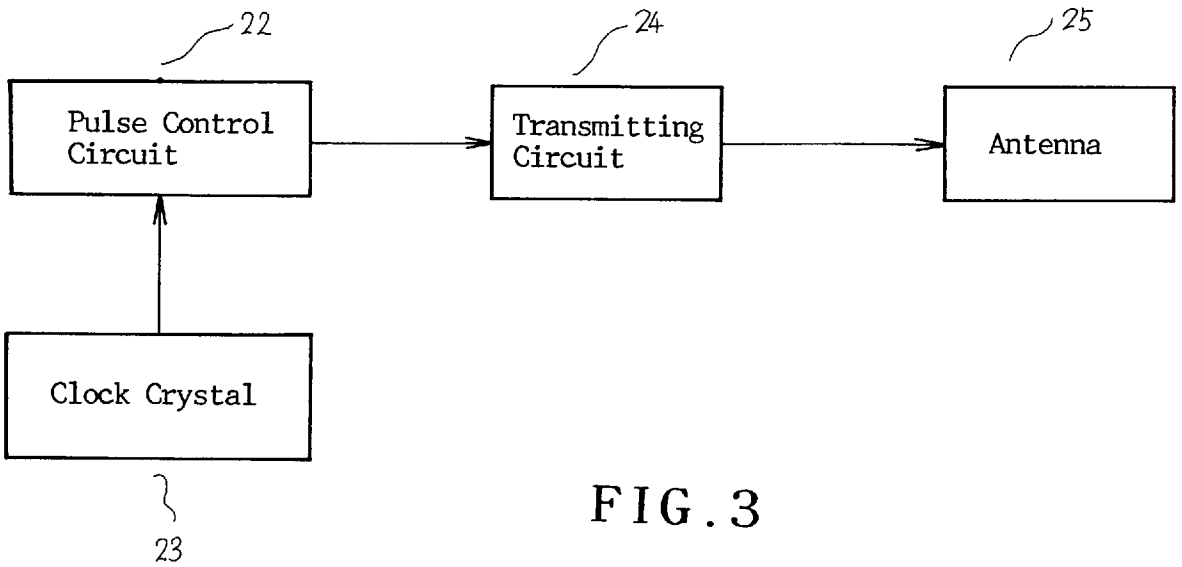
FIG. 3 is a block circuit diagram of the transmitter unit of the present invention.
Figure 4:
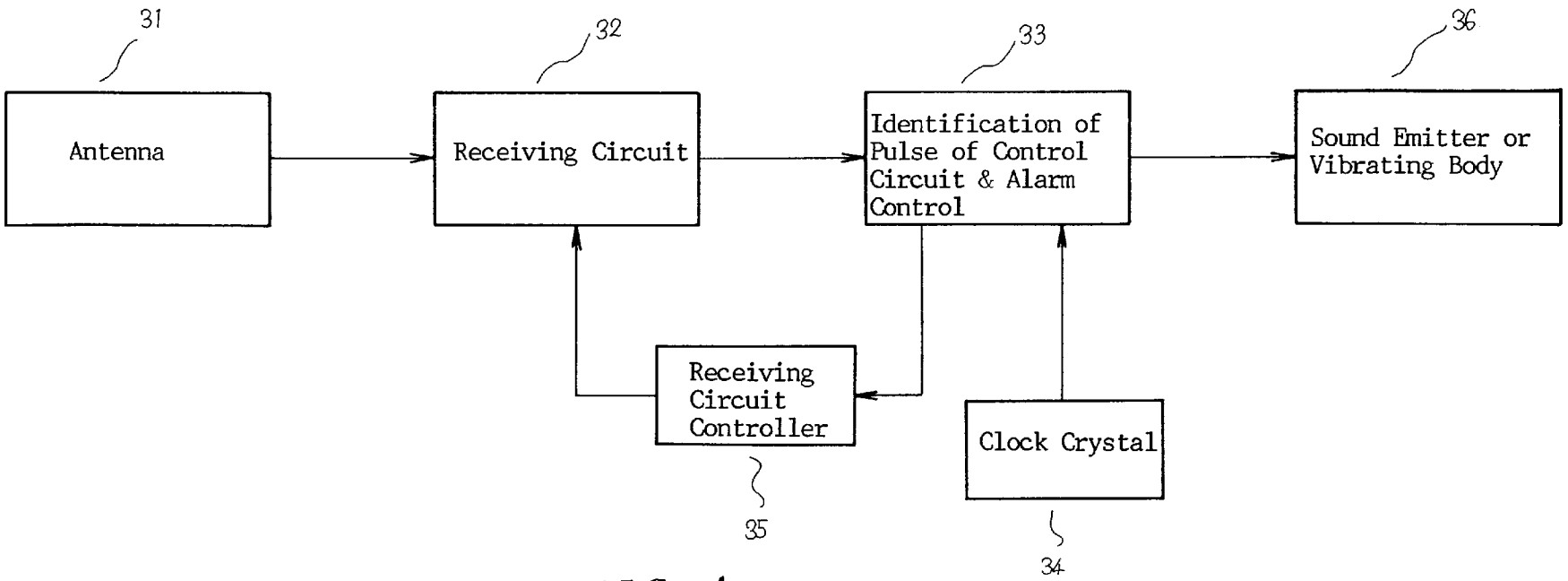
FIG. 4 is a block circuit diagram of the receiver unit of the present invention.

Please refer to FIGS. 3 and 4. The synchronous receiving/transmitting departure alarm of the present invention includes at least one transmitter unit and a receiver unit.

The transmitter unit includes a pulse control circuit 22, a clock crystal, a transmitting circuit 24 and an antenna 25.

The receiver unit includes an antenna 31, a receiving circuit 32, a control circuit 33, a clock crystal 34, a receiving circuit controller 35 and a sound emitter or vibrating body 36.

Figure 5:
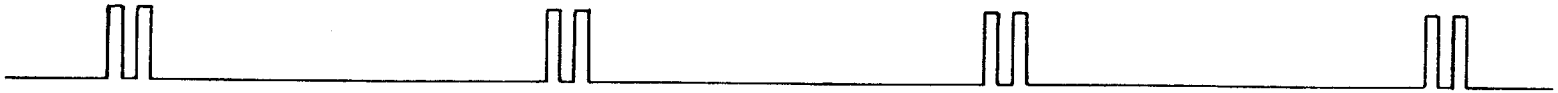
FIG. 5 is a timing diagram of the clock pulses of the present invention in one state.
Figure 5:
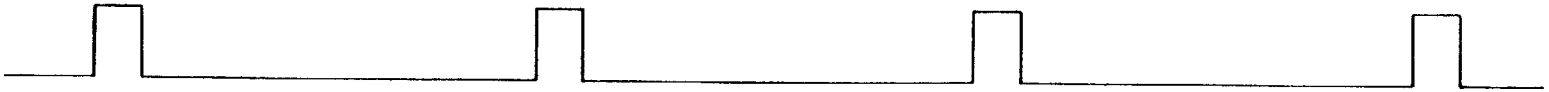

The above alarm operates as follows:

1. Signal transmission of the transmitter unit is carried out by causing the clock crystal 23 and the pulse control circuit 22 to accurately control the time to transmit a pulse and activate the transmitting circuit 24. The pulse generated by the clock crystal 23 and the pulse control circuit 22 is transmitted as a pulse signal through the transmitting circuit 24 and the antenna 25. This signal is an intermittently transmitted clock pulse. The transmitting time is as shown in A of FIG. 5.

2. Signal receiving of the receiver unit is carried out by causing the receiver unit to automatically use the pulse clock of the transmitter unit for timing. The clock crystal 34 and the control circuit 33 serve to generate an oscillation pulse which is the same as that of the transmitter unit and accurately controls the receiving circuit controller 35 so as to keep activation of the receiving circuit synchronism with the transmitting time of the transmitter unit as shown in B of FIG. 5. The signal received by the antenna 31 is identified by the receiving circuit 32 and the control circuit 33. In the case that the received pulse signal is correct, the receiving circuit controller 35 deactivates the receiving circuit 32 at proper time and waits for the next transmitted pulse signal. Before the next transmitted pulse signal is generated, the receiving circuit 32 is again activated for receiving the signal. In the case that the receiving circuit 32 fails to receive the transmitted pulse once or continuously several times, the sound emitter or the vibration body 36 emits a sound or vibrates to warn the holder of the receiver unit. For example, when a person (such as an old man or a child) or a precious article carrying the transmitter unit is away from the holder of the receiver unit by a sufficiently far distance, making the receiver unit fail to receive the signal transmitted by the transmitter unit, the receiving unit will warn the holder thereof by way of sound or vibration so as to achieve a warning effect.

Figure 6:
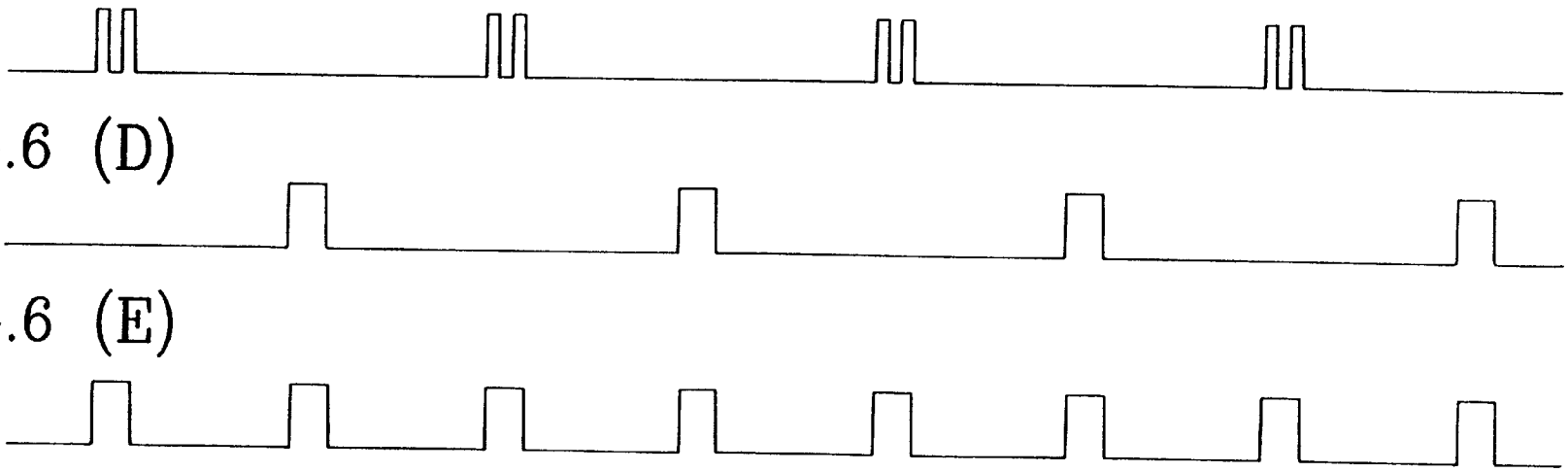
FIG. 6 is a timing diagram of the clock pulses of the present invention in another state.

In use, one receiver unit can cooperate with more than one transmitter unit at the same time. The receiver unit can lock the time to receive the pulse of each transmitter unit as shown in FIG. 6. In case the opening time of the receiver unit is E and the time to transmit the signal of each transmitter unit is C, D, as shown in FIG. 6, the opening time of the receiving circuit can overlap and correspond to the transmitting time of each transmitter unit. Therefore, one receiver unit can cooperate with multiple transmitter units at the same time. For example, when the holder of the receiver unit needs to take care of a child and carry a mobile phone, two transmitter units can be respectively installed on both the child and the mobile phone so as to prevent the child from becoming missing as well as to prevent the mobile phone from being forgotten.

Figure 7:
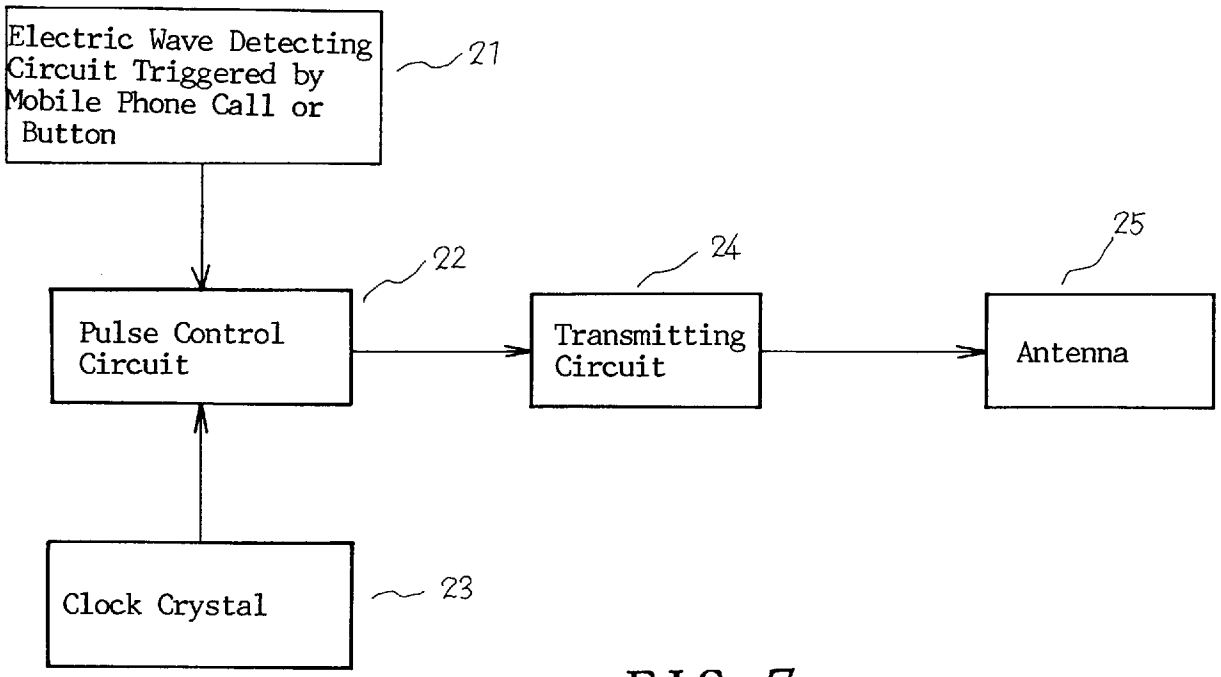
FIG. 7 is a block circuit diagram of another embodiment of the present invention.
Figure 8:
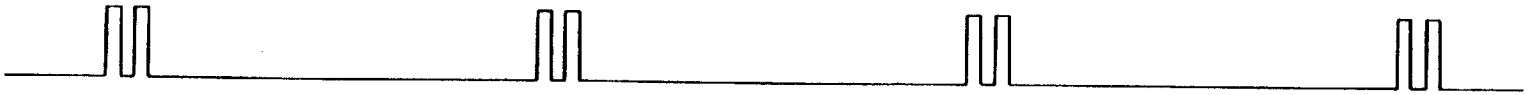
FIG. 8 is a timing diagram of the clock pulses of the present invention in still another state.
Figure 8:
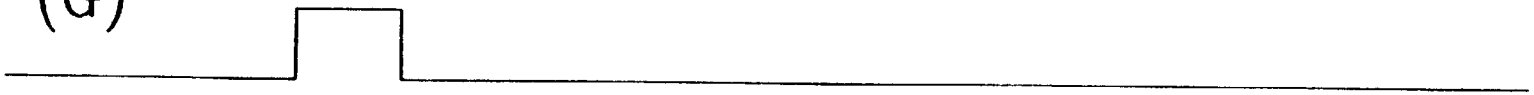

Referring to FIG. 7 which shows another embodiment of the present invention, an electro-magnetic wave or button detecting circuit 21 is added to the transmitter unit, so that the unit can be triggered by a phone call detector or by a button disposed on the transmitter unit. When the holder of the transmitter unit needs emergency help, the holder can press down the button disposed on the transmitter unit to activate the detecting circuit 21 so as to change the waveform of the transmitted wave of the transmitter unit or make the transmitter unit stop transmitting the signal, at which time the receiver unit can generate a sound or vibration to warn the holder of the receiver unit that rescue is required. This embodiment can also be used in connection with a mobile phone. When another person calls, the phone call detector will automatically trigger the detecting circuit 21 to remind the mobile phone holder to immediately pick up the phone for communication. By means of the above measure, during a certain period G, the waveform of the transmitted pulse is changed or the transmission is stopped ( as shown in FIG. 8 ) so as to be distinguished from the time F for transmission of a normal pulse and thereby achieve a warning effect.

According to the above arrangement, by means of the pulse clock control (the time is calculated on the basis of microseconds), the usage time of the alarm is effectively prolonged and the power consumption is reduced. Also, the receiver unit and transmitter unit can be easily carried by the user and one receiver unit can cooperate with multiple transmitter units at the same time so as to achieve the functions of personal care, emergency rescue and phone call detection.

The above embodiments are only examples of the present invention and the scope of the present invention should not be limited to the above examples. Any modification or variation derived from the examples should fall within the scope of the present invention.

What is claimed is:

1. A synchronous receiving/transmitting departure alarm comprising at least one transmitter unit and a receiver unit, wherein:

the transmitter unit includes a pulse control circuit, a clock crystal, a transmitting circuits and an antenna which form a means for transmitting pulse signals at fixed time intervals; and the receiver unit includes an antenna, a receiving circuit, a control circuit, a clock crystal, a receiving circuit controller, and a sound emitter or vibrating body which form a means for receiving said pulse signals and synchronizing said receiver and transmitter so that during the intervals between said pulse signals, the receiving circuit of the receiver unit is synchronously deactivated and before a next transmitted pulse signal is to be received the receiving circuit is again activated for receiving the next pulse signal from the transmitter unit, and whereby when the receiving circuit fails to receive the transmitted pulse signal once or continuously several times, the receiver unit by way of sound or vibration warns a holder of the receiver unit of the failure to receive the transmitted pulse signal, and wherein the transmitter unit further includes an electro-magnetic wave detecting circuit responsive to detection of an electro-magnetic wave for changing or stopping transmission of said pulse signals to thereby cause said receiving unit to warn the holder by sound or vibration that an electro-magnetic wave has been detected.

2. The alarm as claimed in claim 1, further comprising a detecting circuit in the transmitter unit, said detecting circuit being triggered by a button disposed on the transmitter unit so as to change or stop transmission of the pulse signals and thereby cause the receiver to warn the holder that the button has been pressed and that a carrier of the receiver unit is in need of rescue.

3. The alarm as claimed in claim 1, wherein the electromagnetic wave detective circuit is a phone call detector disposed in the transmitter unit, whereby the transmitter unit causes the receiver unit to generate a sound or vibration to inform the holder of the receiver unit of the phone call.

4. The alarm as claimed in claim 1, wherein the receiver unit cooperates with more than one transmitter unit at the same time.

* * * * *